US007264490B1

(12) United States Patent
Reznikov

(10) Patent No.: US 7,264,490 B1
(45) Date of Patent: Sep. 4, 2007

(54) ELECTRONIC EQUIPMENT MODULE WITH LATCHING INJECTOR/EJECTOR

(75) Inventor: Naum Reznikov, Fremont, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 180 days.

(21) Appl. No.: 11/129,887

(22) Filed: May 16, 2005

(51) Int. Cl.
*H01R 13/62* (2006.01)

(52) U.S. Cl. ..... 439/152; 439/327; 439/377

(58) Field of Classification Search ..... 439/296, 439/152, 153, 157, 160, 64, 327, 377, 923, 439/159; 361/754, 798
See application file for complete search history.

(56) References Cited

U.S. PATENT DOCUMENTS

| | | | | |
|---|---|---|---|---|
| 3,193,342 | A | 7/1965 | Sauter | |
| 3,245,546 | A * | 4/1966 | Stuhler | 211/41.17 |
| 3,899,794 | A | 8/1975 | Brown, Jr. | |
| 4,365,831 | A | 12/1982 | Bourne | |
| 4,421,372 | A | 12/1983 | Golden | |
| 4,435,029 | A * | 3/1984 | McKenzie | 312/332.1 |
| 4,597,173 | A | 7/1986 | Chino et al. | |
| 4,778,401 | A | 10/1988 | Boudreau et al. | |
| 4,872,853 | A | 10/1989 | Webster | |
| 4,941,841 | A | 7/1990 | Darden et al. | |
| 5,003,431 | A | 3/1991 | Imsdahl | |
| 5,172,520 | A | 12/1992 | Hostetler et al. | |
| 5,222,897 | A | 6/1993 | Collins et al. | |
| 5,229,919 | A | 7/1993 | Chen | |
| 5,255,154 | A | 10/1993 | Hosoi et al. | |
| 5,332,306 | A | 7/1994 | Babb et al. | |
| 5,442,513 | A | 8/1995 | Lo | |
| 5,483,419 | A | 1/1996 | Kaczeus, Sr. et al. | |
| 5,504,648 | A | 4/1996 | Honda et al. | |
| 5,506,758 | A | 4/1996 | Cromwell | |
| 5,557,499 | A | 9/1996 | Reiter et al. | |
| 5,563,767 | A | 10/1996 | Chen | |
| 5,653,518 | A | 8/1997 | Hardt | |
| 5,654,873 | A | 8/1997 | Smithson et al. | |
| 5,673,172 | A | 9/1997 | Hastings et al. | |
| 5,691,859 | A | 11/1997 | Ulrich et al. | |
| 5,734,557 | A | 3/1998 | McAnally et al. | |
| 5,765,933 | A | 6/1998 | Paul et al. | |
| 5,980,281 | A | 11/1999 | Neal et al. | |
| 6,056,567 | A | 5/2000 | Schell | |
| 6,067,225 | A | 5/2000 | Reznikov et al. | |
| 6,193,339 | B1 | 2/2001 | Behl et al. | |
| 6,252,514 | B1 | 6/2001 | Nolan et al. | |
| 6,288,902 | B1 | 9/2001 | Kim et al. | |
| 6,315,586 | B1 * | 11/2001 | Joyce et al. | 439/157 |

(Continued)

*Primary Examiner*—Tho D. Ta
(74) *Attorney, Agent, or Firm*—Meyertons Hood Kivlin Kowert & Goetzel, P.C.; B. Noël Kivlin; Chris D. Thompson

(57) ABSTRACT

A module includes a panel having a groove. An injector/ejector may be coupled to the panel. The injector/ejector may reside in the groove when the injector/ejector is in a closed position. A latch member may be coupled to the panel. The latch member may selectively hold the injector/ejector in the closed position in the groove. A body of the latch member may reside in a groove in the panel. In certain embodiments, latch member for a module injector/ejector is attached to the panel using a snap-on arrangement. In certain embodiments, the panel for a module may be made of a flat sheet having a fold that defines the groove.

20 Claims, 6 Drawing Sheets

U.S. PATENT DOCUMENTS 6,371,433 B2 4/2002 Anderson et al.
6,373,713 B1 4/2002 Jensen et al.
6,378,965 B1 4/2002 Reznikov et al.
6,392,892 B1 5/2002 Sobolewski
6,413,122 B2 7/2002 Fujioka
6,433,825 B1 8/2002 Cama et al.
6,618,264 B2 9/2003 Megason et al.
6,762,934 B2 7/2004 Kitchen et al.
6,795,307 B2 9/2004 Arbogast et al.
6,798,650 B2 9/2004 Reznikov et al.
6,802,117 B2 10/2004 Dalisay
7,018,227 B2 * 3/2006 Takahashi ..... 439/347

* cited by examiner

ELECTRONIC EQUIPMENT MODULE WITH LATCHING INJECTOR/EJECTOR

BACKGROUND OF THE INVENTION

1. Field of the Invention

This invention relates generally to electronic equipment, such as computers, and, more particularly, to apparatus used during insertion and extraction of circuit boards from electronic systems.

2. Background Information

Electronic systems such as computers are typically constructed in a modular fashion. For example, a system may include number of circuit boards, each circuit board generally performing a specific function. Each circuit board requires multiple electrical connections, which are generally provided by two part multi-contact electrical connectors. One part of the connector is mounted to the circuit board, while a mating part of the connector may be attached to another component of the system such as a rack, a chassis, a cable, or another circuit board (e.g., backplane circuit board). Successful mating of connector parts is needed for reliable electrical connections in the system. The system may include other modules, such as power supplies, disk drives, and fan tray assemblies.

A number of mechanisms are known for injecting a module into a chassis or extracting a module from a chassis. Such mechanisms may include levers pivotally coupled to the circuit board and arranged to engage projections formed on the chassis. Guide formations may be provided on the chassis to receive the module and to guide the module into position. The levers may be arranged on the circuit board such that when the lever are actuated, the circuit board is provided with a biasing force that serves to move the circuit board toward the rear of the chassis. The biasing force is used to mate the parts of the electrical connector on the module with corresponding connector parts in the chassis.

For circuit boards with connectors having a relatively large number of pins, large insertion forces may be required to mate the connector parts. For example, a large board may contain several multi-contact connectors, each connector containing several hundred individual contacts. Each contact requires the application of an insertion force to seat the contact. Thus, the total insertion force required to seat a large board may be 65 pounds or more. Moreover, individual contacts are easily damaged if the mating connector parts are not properly aligned when they come into contact with each other. This problem is especially acute where large forces are required to mate the connector parts.

Injection/extraction mechanisms, and the mounting hardware associated with the mechanisms, consume space near the front of a module. The size of some mechanisms may require that the width and/or height of a slot for a given module be increased. Portions of a mechanism (e.g., lever arms) may also take up space outside a front panel of a module. In addition, apertures must be provided in the module, chassis, and/or EMI seals to provide clearance for the levers and/or other hardware. Electromagnetic radiation may pass through the apertures, creating electromagnetic interference with the system.

SUMMARY OF THE INVENTION

Various embodiments of apparatus and methods for injecting and ejecting modules (e.g., circuit modules, fan tray assemblies) are disclosed. In an embodiment, a module includes a panel having a groove. An injector/ejector may be coupled to the panel. The injector/ejector may reside in the groove when the injector/ejector is in a closed position. A latch member may be coupled to the panel. The latch member may selectively hold the injector/ejector in the closed position in the groove. In some embodiments, a spring (e.g., a torsion spring) is provided to urge the injector/ejector into an open position when the latch member moved out of engagement with the injector/ejector.

In an embodiment, a latch member for module injector/ejector has a body and a spring portion. The latch member may be used to selectively latch and release the injector/ejector. The body of the latch member may reside in a groove in a front panel of the module. The body of the latch member may move within a limited range of motion in the groove. The walls of the groove may guide the latch member. In some embodiments, the spring portion of the latch member resiliently urges the body of the latch member into engagement with the injector/ejector when the injector/ejector is placed in a closed position. The spring portion may allow the body of the latch member to deflect to allow the injector/ejector to be released from the latch member. When the user lets go of the latch member, the spring portion may return the body of the latch member to a rest position.

In an embodiment, a latch member for a module injector/ejector is attached to a panel of the module using a snap-on arrangement. The latch member may include one or more protrusions that snap into apertures in the panel. In some embodiments, one or more of the apertures is slotted to allow movement of a portion of the latch member to release the latch member from the injector/ejector.

In an embodiment, a front panel for a module may be made of a flat sheet (e.g., sheet metal). The flat sheet may have a fold that defines the groove. The groove may receive an injector/ejector for the module. In some embodiments, the panel may have flanges along the outer edge of the panel that extend in the same direction as the fold.

In an embodiment, a module assembly includes a chassis that houses some or all of the components of the module assembly. An EMI gasket may be provided between the chassis and a front panel of the module assembly. The chassis, front panel, and EMI gasket may include slots that allow for passage of an injector/ejector for the module assembly. The chassis, front panel, and EMI gasket, and injector/ejector may combine to form an EMI enclosure for components in the module. In one embodiment, the module assembly includes a pair of injector/ejectors that each engages one side of a rack.

BRIEF DESCRIPTION OF THE DRAWINGS

Other aspects of the invention will become apparent upon reading the following detailed description and upon reference to the accompanying drawings in which.

Figure 1:
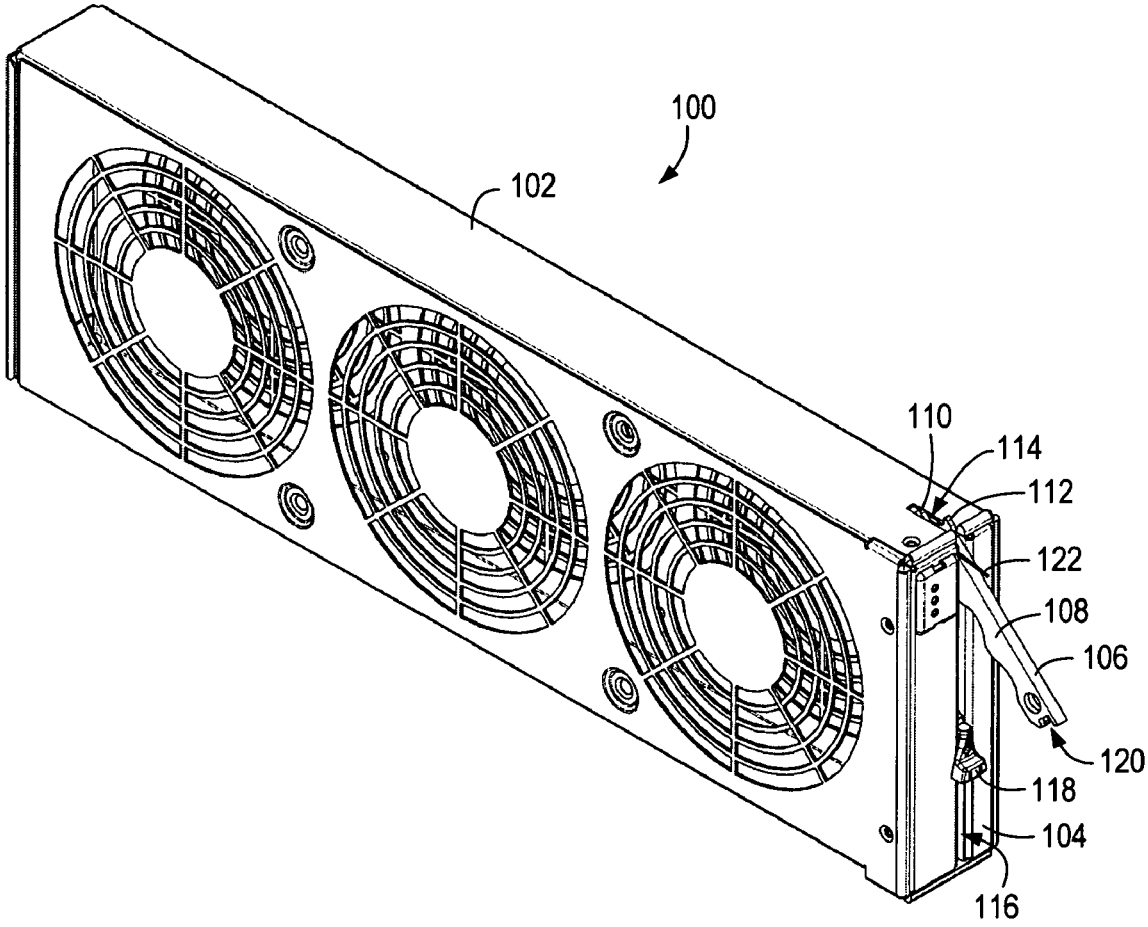
FIG. 1 depicts a fan tray assembly including an injector/ejector.

While the invention is susceptible to various modifications and alternative forms, specific embodiments thereof are shown by way of example in the drawings and will herein be described in detail. It should be understood, however, that the drawings and description thereto are not intended to limit the invention to the particular form disclosed, but, on the contrary, the invention is to cover all modifications, equivalents, and alternatives falling with the spirit and scope of the present invention as defined by the appended claims.

DETAILED DESCRIPTION OF THE INVENTION

The following description generally relates to apparatus and methods for installing and removing modules from computer systems. Such systems and methods may be used in a variety of applications. A non-exhaustive list of such applications includes: telecommunications network server systems; e-commerce web server systems; LAN application and file server systems; personal computer systems; and remote vehicle control systems.

As used herein, "module" includes any modular unit or subsystem. Examples of a module include, but are not limited to, a printed circuit board assembly, an information-processing cartridge, a fan tray assembly, a disk drive, a memory module, a power supply, or a combination thereof. In certain embodiments, a module may include multiple circuit boards (e.g., a mezzanine card mounted to a main circuit board). In certain embodiments, components of a module may be housed in an enclosure.

As used herein, "circuit module" includes any module that includes or carries elements of an electrical circuit, electrical components (including, but not limited to, semiconductor devices, resistors, capacitors, relays, switches, and connectors), or conductors (e.g., wires, traces). As used herein, "circuit board" includes any circuit module that carries one or more other circuit modules or components. "Circuit board" includes, but is not limited to, a printed circuit board made of epoxy-glass and metal layers. As used herein, "component" includes any element of system, including, but not limited to, a printed circuit board, a semiconductor device, a resistor, a capacitor, a power supply, or a disk drive.

A computer system may include components installed in a chassis or rack assembly. As used herein, "rack" includes any structure that supports or houses one or more elements of a computer system (e.g., electronic modules). A component may be supported in a rack by various structures including, but not limited to, slides, rails, a shelf, or a bottom of a rack. As used herein, "enclosure" or "chassis" includes any structure that supports or houses one or more elements of a module or modules.

In an embodiment, a module is a fan tray assembly. FIG. 1 depicts fan tray assembly 100. Fan tray assembly 100 may include chassis 102, front panel 104, and injector/ejector 106. Injector/ejector 106 may be pivotally connected to front panel 104. Injector/ejector 106 may be operated to couple and decouple fan tray assembly 100 to and from a rack. In other embodiments, injector/ejectors may be provided on other sides of a module (e.g., rear, top, or bottom).

As used herein, "injector/ejector" includes any element that may be used to inject a component into a system, eject a component from a system, or both. As used herein, to "inject" generally means to couple a component to a system or another component. "Injecting" a circuit board may include, but is not limited to, advancing a circuit board to couple a connector part on the circuit board with a mating connector part on another component (e.g., a backplane). As used herein, to "eject" generally means to decouple a component from a system or another component. "Ejecting" a circuit board may include, but is not limited to, withdrawing a circuit board to decouple a connector part on the circuit board from a mating connector part on another component (e.g., a backplane). Examples of injector/ejector devices include, but are not limited to, levers, screws, rods, cams, hooks, or pins.

Injector/ejector 106 may include handle 108, inject portion 110, and eject portion 112. Inject portion 110 and eject portion 112 may move within chassis slot 114 in chassis 102 when injector/ejector 106 is actuated using handle 108. As further described herein, injector/ejector 106 may be position to selectively engage inject portion 110 and eject portion 112 on a fixed structure on a rack (e.g., a side rail) to couple fan tray assembly 100 with the rack and decouple the fan tray assembly from the rack.

As shown in FIG. 1, an injector/ejector may in some embodiments be provided on only one side (e.g., top, bottom, left side, or right side) of a module. In other embodiments, injector/ejectors may be provided on each of the opposing sides of a module (e.g., top and bottom). In still other embodiments, an injector/ejector may be provided in other locations of a module (e.g., the center of a module).

Front panel 104 may include groove 116. Injector/ejector 106 may reside in groove 116 when injector/ejector 106 is placed in a closed position (e.g., after injection of fan tray assembly 100). As used herein, "groove" generally refers to any groove, channel, recess, hollow, or depression in a surface. As shown in FIG. 1, groove 116 may in some embodiments extend across front panel 104. In other embodiments, a groove may extend over only a portion of a front panel. A groove may have various regular or irregular cross sections.

Fan tray assembly 100 may include latch member 118. Latch member 118 may be movably coupled to front panel 104. Latch member 118 may engage notch 120 on injector/ejector 106 to hold injector/ejector 106 in a closed position in groove 116 of front panel 104. As used herein, "member" may include a single member or multiple members. Portions of a member may be straight and/or curved, flexible and/or rigid, or a combination thereof. A latch member may include various elements for selectively holding and releasing an injector/ejector. Suitable latch types include, but are not limited to, a slider, a push knob latch, coil spring latch, or touch latch.

Fan tray assembly 100 may include torsion spring 122. Torsion spring 122 may be coupled between injector/ejector and front panel 104. Torsion spring 122 may bias handle 108 of injector/ejector 106 away from front panel 104. Injector/ejector 106 may rotate to an open position (e.g., with handle 108 away from front panel 104) when latch member 118 is moved out of engagement with injector/ejector 106.

Figure 2:
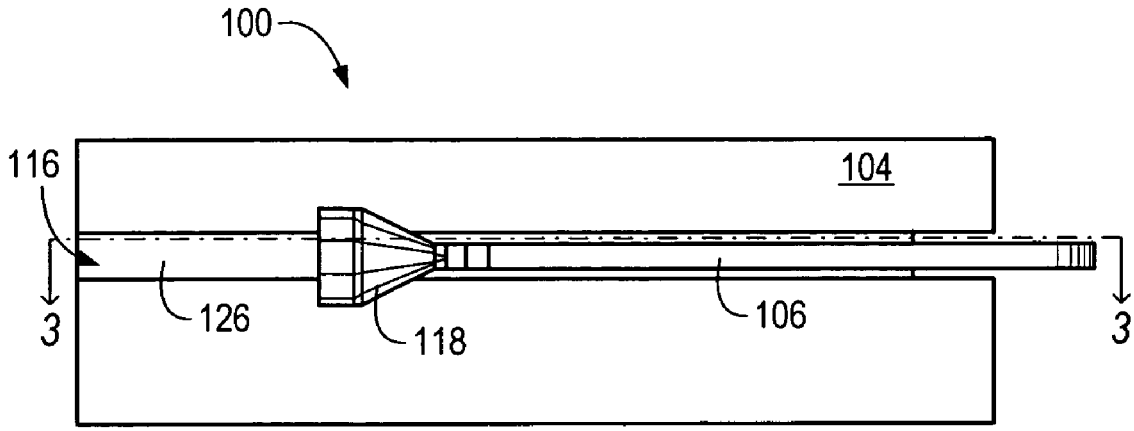
FIG. 2 is a front view of a front panel coupled to an injector/ejector in a closed position.
Figure 3:
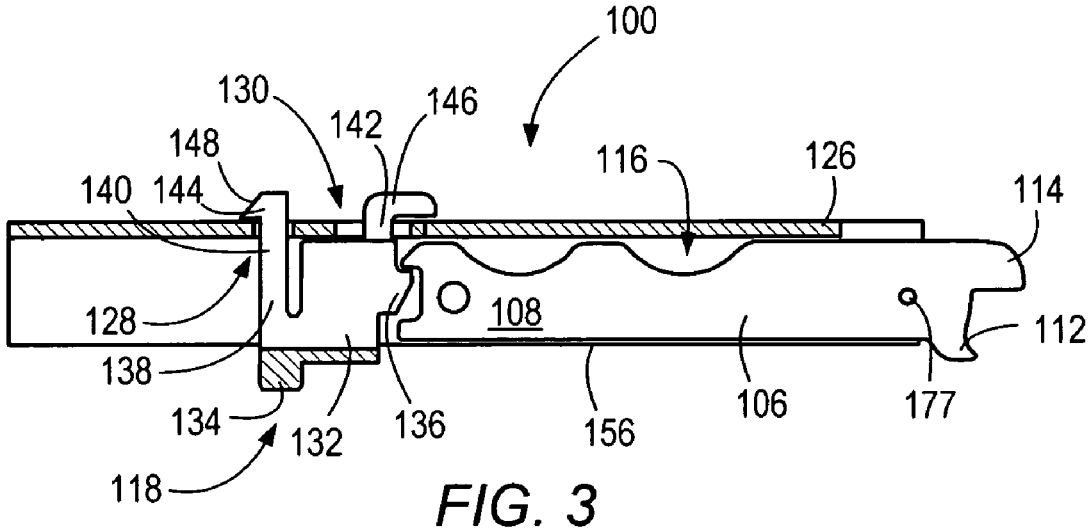
FIG. 3 is a cross sectional view of a front panel coupled to an injector/ejector in a closed position taken along lines 3-3 of FIG. 2.

FIG. 2 is a front view of fan tray assembly 100. FIG. 3 is a cross sectional view of fan tray assembly 100 showing front panel 104, injector/ejector 106, and latch member 118. Injector/ejector 106 may be coupled to front panel 104. Rear wall 126 of front panel 104 may include hole 128 and slot 130 for receiving latch member 118. Hole 128 and slot 130 may have various shapes and sizes, including, but not limited to, round, square, diamond-shaped, hexagonal, or hexalobular.

Latch member 118 may be attached to front panel 104 using a snap-on arrangement. Latch member 118 may include mounting protrusions (e.g., tabs, legs, or pins) that couple in apertures (e.g., holes, slots) of front panel 104. As shown in FIGS. 2-3, latch member 118 may include latch body 132, release portion 134, engaging portion 136, spring portion 138, legs 140, 142, and projections 144, 146. Release portion 134 may be operated by a user (e.g., by pressing with the user's thumb) to manually release latch member 118 from engagement with injector/ejector 106.

Projections 144, 146 may extend in a transverse direction relative to legs 140, 142. Leg 140 may include lead-in taper 148 to facilitate engagement of leg 140 in hole 128. In certain embodiments, leg 142 may include a taper. While latch member is depicted in FIGS. 2-3 as a snap-on member, a latch member may in other embodiments be attached to a module using other suitable arrangements, such as a screw, a clip, a bolt, a rivet, or adhesive.

As used herein, "spring portion" includes any resiliently deformable (e.g., bendable) member or combination of members, and includes, but is not limited to, a beam, bar, rod, coil, or combination of such elements. As shown in FIG. 3, spring portion 138 may in some embodiments be a relatively thin and flexible section of leg 140 that allows the distal end of leg 140 to deflect relative to latch body 132. In other embodiments, both legs may include flexible portions. In an embodiment, latch member 118 is formed as a single member (e.g., by injection molding). Forming a latch member as a single part may reduce a cost of producing a latch system, as compared with a latch system produced from separate parts. In other embodiments, however, a latch member may be a combination of separate parts. For example, a spring, such as a torsion spring, coil spring, or elastomeric member, may be provided as a separate component of the latch member.

To install latch member 118 on front panel 104, legs 140, 142 may be brought toward each other (e.g., by squeezing the sides of the latch member) such that projections 144, 146 align with hole 128 and slot 130. Legs 140, 142 may be inserted into hole 128 and slot 130, respectively. After projections 144, 146 pass through hole 128 and slot 130, spring portion 138 may return latch member 118 to a free state, spreading legs 140, 142 away from each other. Projections 144, 146 may overlap rear wall 126 of front panel 104 such that latch member 118 is retained in groove 116. As shown in FIG. 3, slot 130 may allow release portion 134 to be moved laterally such that latch member 118 is disengaged from notch 120 of injector/ejector 106. Projection 146 may be of sufficient length to maintain latch member 118 in groove even when latch member 118 is positioned to release injector/ejector 106.

Latch body 132 may reside in groove 116 behind forward edge 156 of front panel 104 when latch member 118 is installed on front panel 104. When injector/ejector 106 is in a closed position, handle 108 of injector/ejector 106 may also be behind the forward edge 156 of front panel 104. Including a groove on a front panel of a module may allow the module to have a low profile at the front of the module. As shown in FIG. 3, release portion 134 of latch member 118 may protrude beyond forward edge 156 of front panel 104. In other embodiments, a release portion for a latch member may be recessed behind the forward edge of the module.

Figure 4:
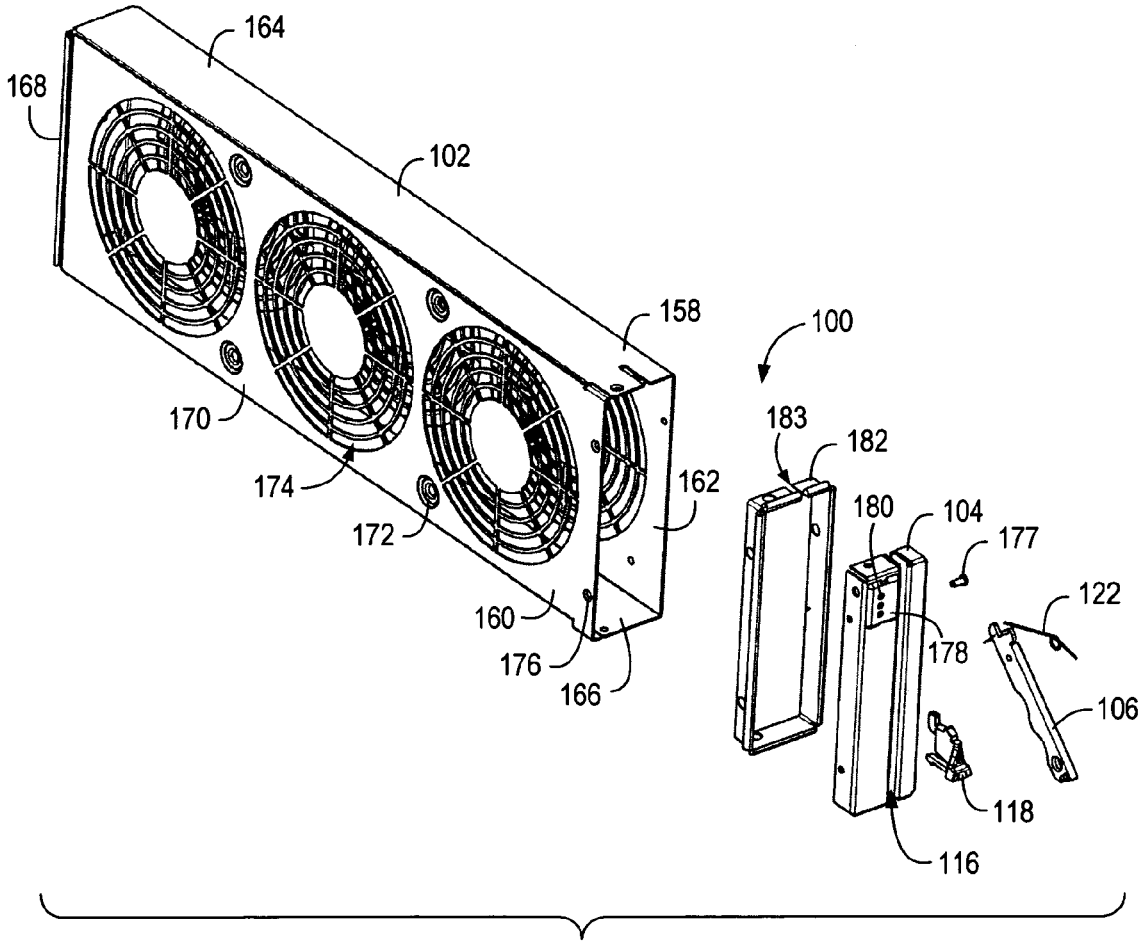
FIG. 4 is an exploded view of a fan tray assembly.

FIG. 4 is an exploded view of fan tray assembly 100. Chassis 102 may include chassis body 158 and cover 160. Chassis body 158 may include right panel 162, top panel 164, bottom panel 166, and rear panel 168. Cover 160 may include left panel 170. Fasteners 172 may be used to attach cover 160 to chassis body 158. Right panel 162 of chassis body 158 and left panel 170 of cover may include vents 174. Vents 174 may allow for passage of air through fan tray assembly 100. For simplicity, fans are not shown in FIG. 4. It will be understood, however, that fans may be provided inside chassis 102 adjacent to each of vents 174.

Fan tray assembly 100 may include fasteners 176. Fasteners 176 may be used to attach front panel 104 to chassis body 158 and cover 160. Injector/ejector 106 may be coupled to front panel 104 using pin 177. Front panel 104 may include indicator panel 178. Indicator panel 178 may include status visual indicators 180 (e.g., light emitting diodes) that provide visual status regarding the operation of the fan tray assembly 100.

EMI gasket 182 may be provided between chassis 102 and front panel 104. EMI gasket may include gasket slot 183. Gasket slot 183 may allow for passage of injector/ejector 106. Gasket slot may be slightly larger than the thickness of the injector/ejector. EMI gasket 182 may be formed of beryllium copper, conductive elastomer, or various other materials that provide electromagnetic shielding. EMI gasket 182 may contain electromagnetic energy generated by fans in fan tray assembly 100. It will be understood that EMI gasket may be used to contain electromagnetic energy produced by other components on a module such as processors or disk drive motors. In some embodiments, a gasket for a module may shield components in the module from electromagnetic energy produced by components surrounding the module.

Figure 5:
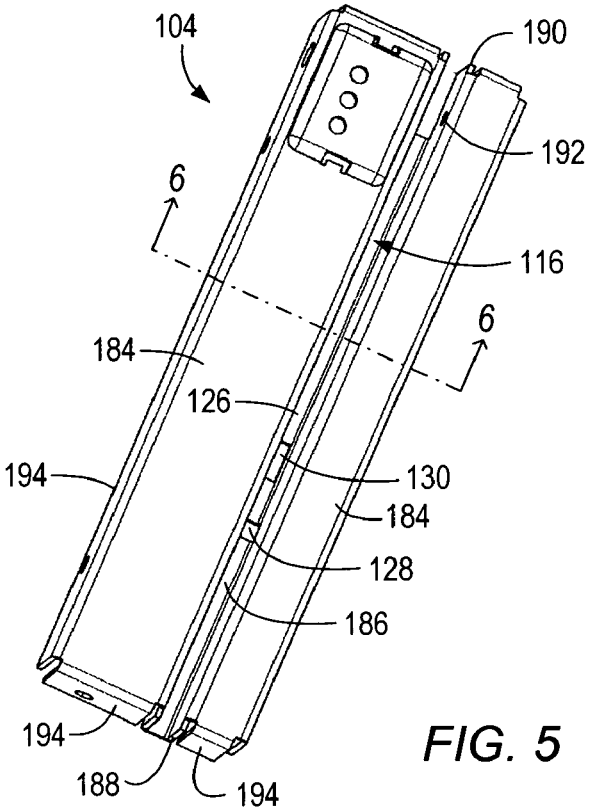
FIG. 5 depicts a front panel for a fan tray assembly.

FIG. 5 depicts front panel 104. Front panel 104 may be formed from sheet metal stock. Producing a front panel from sheet metal stock may allow the front panel to be made as a single, low cost part. Nevertheless, a front panel may in other embodiments be produced by other methods, such machining the panel from stock or injection molding.

Front panel 104 may include front walls 184 and fold 186. Fold 186 may include rear wall 126. Rear wall end slot 190 may allow clearance for injector/ejector 106. Pivot holes 192 may be provided for pinning injector/ejector 106 to front panel 104.

Figure 6:
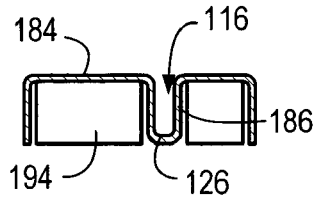
FIG. 6 is a cross sectional view of a front panel taken substantially along lines 6-6 of FIG. 5.

FIG. 6 depicts a cross sectional view of front panel 104. The interior surfaces of fold 186 may define groove 116. Inside surfaces of fold 186 may have various cross sections, such as U-shaped, square, V-shaped, or arcuate. In some embodiments, fold 186 may have a uniform cross section over the length of front panel 104. In other embodiments, the depth of groove 116 may vary over the length of front panel 104.

Front panel 104 may include flanges 194 around the edges of front wall 184. As used herein, "flange" generally refers to any projecting rim, lip, or wall. A flange may have any of various regular or irregular cross sections. A flange may be solid or not solid (e.g., perforated). In some embodiments, flanges extend toward the rear of front panel 104 coextensively with rear wall 126 of fold 186. In other embodiments, flanges 194 may be shorter or longer than fold 186. As shown in FIG. 6, flanges 194 may in some embodiments be proximate to the ends of fold 186. Flanges 194 may partially fill apertures between front wall 184 of front panel 104 and chassis 102, thereby containing radiated emissions from components within the module.

Figure 7:
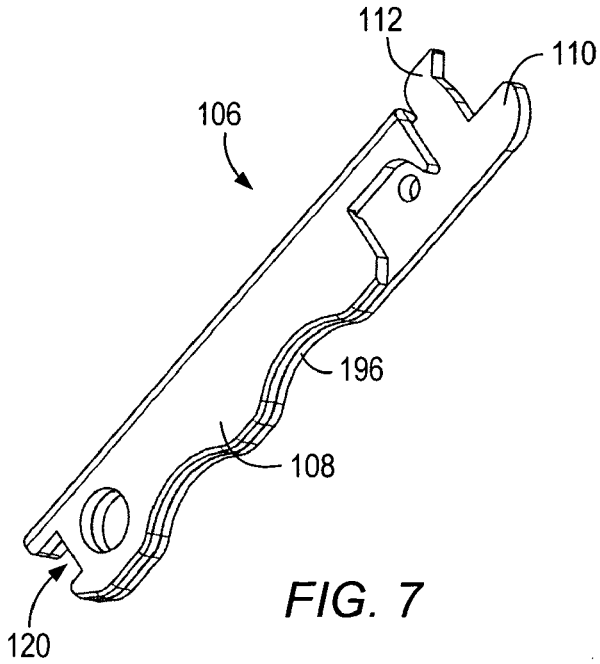
FIG. 7 depicts an injector/ejector.

FIG. 7 depicts an injector/ejector 106. Injector/ejector 106 may be produced folding sheet metal into a flat, U-shaped member. Producing an injector/ejector from sheet metal stock may allow the injector/ejector to be made as a single, low cost part. In addition, a flat, relatively thin injector/ejector may reduce the size of apertures needed in a front panel and/or chassis to operate the injector/ejector, thereby mitigating EMI. In other embodiments, an injector/ejector may be machined, molded, or made using other suitable methods. Handle 108 may include scallops 196 to facilitate gripping by a user.

Referring again to FIGS. 4 and 5, chassis slot 114, gasket slot 183, and rear wall end slot 190 of front panel 104 may combine to form an opening large enough to allow for rotation of injector/ejector to engage and apply forces to a rack structure, but without creating large apertures in the fan tray assembly enclosure (see FIG. 1). In addition, flanges 194 may fill gaps between EMI gasket 182 near the ends of fold 186. Chassis 102, front panel 104, EMI gasket 182, and injector/ejector 106 may combine to form an EMI enclosure for the module.

Figure 8:
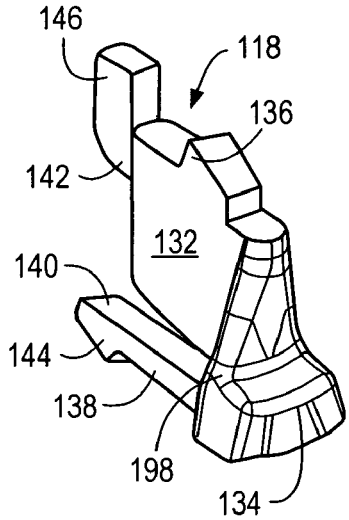
FIG. 8 depicts a latch member for an injector/ejector system.

FIG. 8 depicts latch member 118. Latch member 118 may include connecting portion 198. Connecting portion 198 may be a necked down region that connects spring portion 138 and leg 140 to latch body 132. Latch member may be produced from various suitable materials, including, but not limited to, stainless steel, aluminum, or a polymer (e.g., polyvinyl chloride, ABS). In one embodiment, latch member 118 is a produced as a unitary piece (e.g., injection molded). In other embodiments, latch member 118 may include multiple elements. For example, latch member 118 may include a body and two or more rigid legs connected by a steel spring. Latch member 118 may be produced by other methods, such as machining, stamping, or casting.

As described above, latch members 118 may engage injector/ejector 106 to selectively inhibit or allow movement of one or more elements. As used herein, "engage" or "engaging" includes any condition in which one element engages (e.g., contacts) another element during operation or use of an apparatus.

When injector/ejector 106 is placed in a closed position, engaging portion 136 of latch member 118 may engage in notch 120 in injector/ejector 106, as shown in FIG. 3. Engagement of latch member 118 of engaging portions 136 in notches 120 may inhibit injector/ejector 106 from being rotated away from front panel 104.

Latch member 118 may be disengaged from injector/ejector 106, allowing injector/ejector 106 to rotate with respect to front panel 104. While release portion 134 in the embodiment shown are manually actuated, in other embodiments the releases may automatically actuated. Releases may be actuated by hand or using various devices, including, but not limited to, hand tools power tools, or solenoid devices.

In the embodiment shown in FIGS. 2-3, latch member 118 translates in a lateral direction relative to front panel 104. It will be understood, however, that in other embodiments, the motion of a latch member may take various other forms relative to a module. For example, a latch member may translate from front to back with respect to the module, rotate with respect to the module, or a combination of both.

FIGS. 9-12 depict injector/ejector 106 on fan tray assembly 100 during installation of fan tray assembly 100, and removal of fan tray assembly 100 from, rack 204. It will be understood that in some embodiments an injector/ejector and latch device on the other side of the module assembly may operate in a similar manner.

Figure 9:
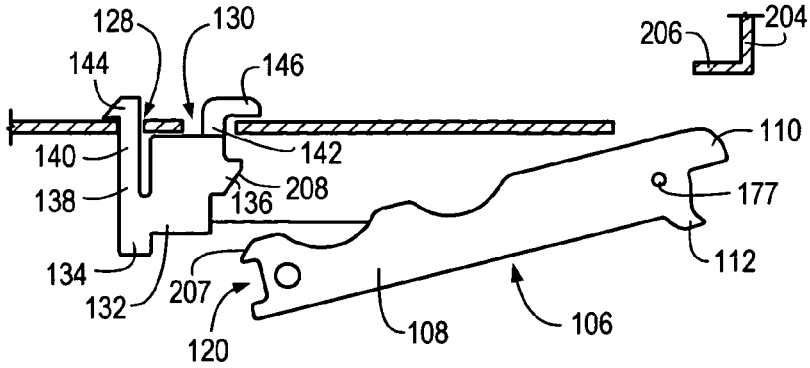
FIG. 9 depicts a fan tray assembly including a latching injector/ejector before installation of the circuit module in a rack.
Figure 10:
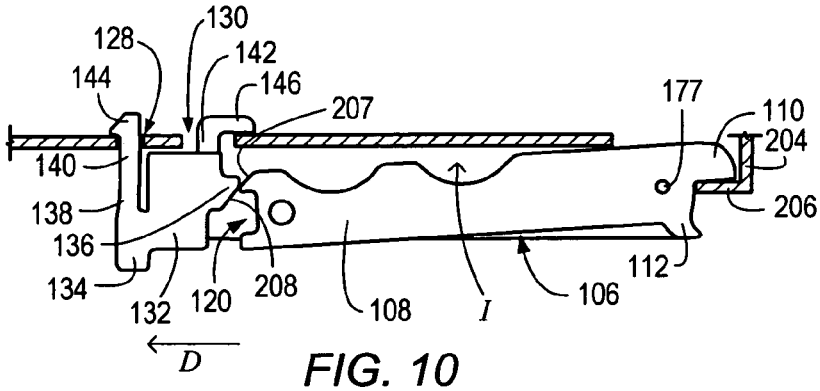
FIG. 10 depicts a fan tray assembly during installation of the fan tray assembly in a rack.

As shown in FIG. 9, prior to installation of fan tray assembly 100, injector/ejector 106 may be biased into an open position by torsion springs 122 (shown in FIG. 3). Referring to FIG. 10, to inject fan tray assembly 100 into rack 204, a user may advance fan tray assembly 100 into rack 204 until inject portions 110 of injector/ejector 106 are past rack formations 206 on rack 204. The user may then rotate injector/ejector 106 in the direction of arrow I such that inject portions 110 engage rack formations 206. Engagement of inject portions 110 with rack formations 206 may force fan tray assembly 100 forward to inject fan tray assembly 100 into rack 204. As injector/ejector 106 are rotated in the direction of arrow I, taper 207 on injector/ejector 106 may slide across complementary taper 208 on latch member 118. Latch member 118 may deflect in the direction of arrow D.

Figure 11:
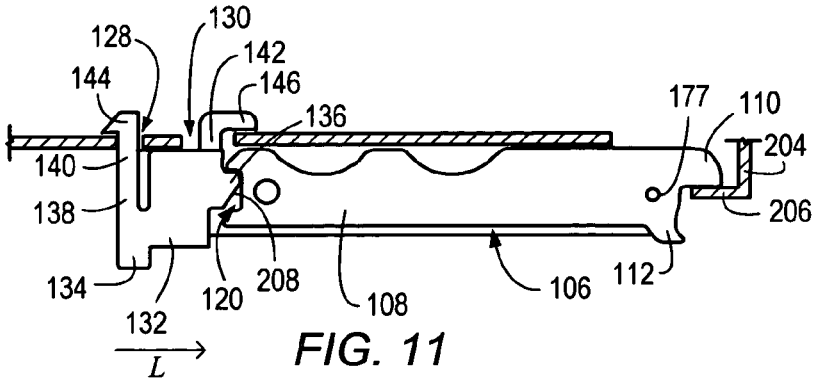
FIG. 11 depicts a fan tray assembly when the fan tray assembly is in an installed position.

Referring to FIG. 11, injector/ejector 106 may be rotated until fan tray assembly 100 is fully inserted into rack 204. Injector/ejector 106 may reach a closed position. Spring portion 138 of latch member 118 may urge latch member 118 in the direction of arrow L such that engaging portion 136 of latch member 118 enters into notch 120 on injector/ejector 106.

Figure 12:
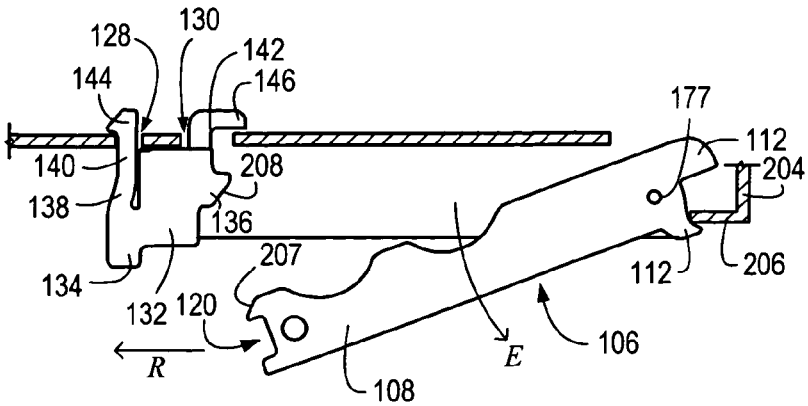
FIG. 12 depicts a fan tray assembly after release of a latching member.

Referring to FIG. 12, to remove fan tray assembly 100 from rack 204, a user may actuate release portion 134 by applying pressure to the release portion with a thumb or finger. Latch member 118 may move in the direction of arrow R. When engaging portion 136 of latch member 118 clears notch 120, injector/ejector 106 may rotate under the spring force of torsion spring 122 (shown in FIG. 3) in the direction of arrow E. Eject portion 112 of injector/ejector 106 may engage rack formation 206 on rack 204. A user may grasp injector/ejector 106 and continue rotation in the direction of arrow E. Injector/ejector 106 may be actuated to force fan tray assembly 100 out of rack 204.

Figure 13:
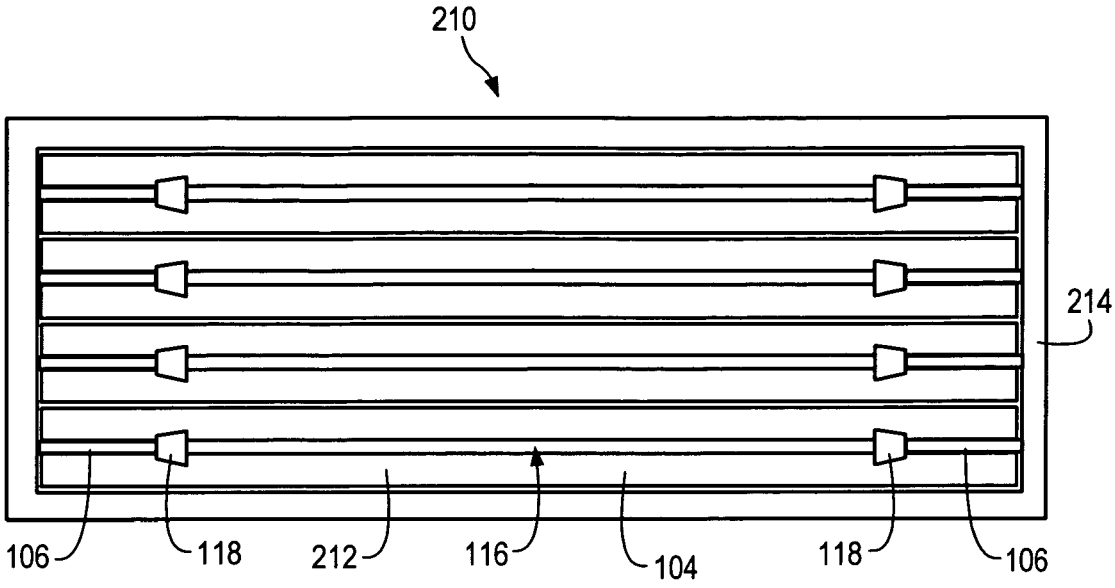
FIG. 13 depicts a computer system including module assemblies with injector/ejector pairs in grooves.

FIG. 13 depicts computer system 210 including module assemblies 212 in rack enclosure 214. Module assemblies 212 may include left and right injector/ejectors 106 coupled to front panels 104. Latch members 118 may be provided to latch injector/ejectors 106 in a closed position in grooves 116. In some embodiments, connector parts on a rear side of module assemblies 212 may couple with mating connector parts in rack enclosure 214 (e.g., backplane connectors) when injector/ejectors 106 are operated to inject module assembly 212. In some embodiments, a combination of rack enclosure 214, front panels 104, and injector/ejectors 106 may form an enclosure for containing EMI. In certain embodiments, one or more EMI gaskets may be provided to seal apertures between rack enclosure 214 and module assemblies 212. When injector/ejectors 106 are in a closed position in grooves 116, injector/ejectors 106 may have a low profile on front side of module assemblies 106. For example, injector/ejectors 106 may be flush with front edges of front panels 104 or recessed behind the front edges of front panels 104. In some embodiments, a cover may be attached (e.g., hinged) to rack enclosure 214 such that the cover contacts, or is in close proximity to, front panels 104.

As used herein, "coupled" includes a direct coupling or an indirect coupling (e.g., with one or more intervening elements) unless expressly stated otherwise. For example, a latch member may be coupled to a front panel by directly attaching the latch member to the front panel, or by mounting the latch member to a bracket attached to the front panel.

While the present invention has been described with reference to particular embodiments, it will be understood that the embodiments are illustrative and that the invention scope is not so limited. Any variations, modifications, additions, and improvements to the embodiments described are possible. These variations, modifications, additions, and improvements may fall within the scope of the inventions as detailed within the following claims. For example, when the terms "vertical," "horizontal," "front," "rear," "upward," "downward," "under," "over," "left," or "right" are used in the claims, they are to be understood to relate to the Figures as illustrated. However, the device may be turned at an angle to the horizontal or inverted with the quoted terms referring to the altered orientation.

What is claimed is:

1. A module, comprising a panel comprising a groove;

an injector/ejector coupled to the panel, the injector/ejector being configured to reside substantially in the groove when the injector/ejector is in a closed position; and a latch member coupled to the panel comprising a body and a release portion, the latch member being configured to latch the injector/ejector in a closed position, wherein the body of the latch member resides substantially in the groove;

wherein the latch member comprises a spring portion, wherein the spring portion is configured to bias the latch member against the injector/ejector to maintain the injector/ejector in a closed position.

2. The module of claim 1, wherein the latch member is configured to snap into engagement with the panel.

3. The module of claim 1, wherein the latch member comprises a plurality of mounting protrusions, wherein the panel comprises a rear wall comprising a plurality of apertures, wherein the protrusions are configured to snap into the apertures to couple the latch member with the panel.

4. The module of claim 1, wherein at least one of the apertures is slotted to allow a portion of the latch member to move relative to the panel.

5. The module of claim 1, wherein the panel comprises a fold, wherein the fold defines the groove.

6. The module of claim 1, wherein the panel comprises a folded metal sheet.

7. The module of claim 1, wherein the panel comprises a fold and at least one flange along an outer edge of the panel, wherein the flange extends in the same direction as the fold.

8. The module of claim 1, further comprising a spring configured to urge the injector/ejector into an open position when the latch member is moved out of engagement with the injector/ejector.

9. The module of claim 1, further comprising an enclosure coupled to the panel wherein the enclosure and the panel each comprises a slot configured to allow a portion of the injector/ejector to move through the slot during use of the injector/ejector.

10. The module of claim 1, wherein the module comprises a pair of injector/ejectors, each of the injector/ejectors configured to engage one side of a chassis.

11. The module of claim 1, further comprising an enclosure housing a portion of the module, the enclosure and the panel each comprise a slot that allows a portion of the injector/ejector to pass through, wherein the enclosure, the panel, and the injector/ejector form an enclosure for containing electromagnetic emissions.

12. The module of claim 11, further comprising an EMI gasket between the enclosure and the panel, wherein the EMI gasket comprises a slot, the slot being configured to allow a portion of the injector/ejector to pass through, wherein the enclosure, the panel, the injector/ejector, and the EMI gasket form an enclosure for containing electromagnetic emissions.

13. A module, comprising a panel comprising a groove;

an injector/ejector coupled to the panel, wherein the injector/ejector is configured to reside substantially in the groove when the injector/ejector is placed in a closed position; and a latch member coupled to the panel the latch member configured to latch the injector/ejector in a closed position, wherein the latch member is configured to snap into at least one aperture in the panel;

wherein the latch member comprises a spring portion, wherein the spring portion is configured to bias the latch member against the injector/ejector to maintain the injector/ejector in a closed position.

14. The module of claim 13, wherein the latch member comprises a body and a release portion, wherein body of the latch member resides substantially in the groove.

15. The module of claim 13, wherein the latch member comprises a plurality of mounting protrusions, wherein the panel comprises a plurality of apertures, wherein the protrusions are configured to snap into the apertures to couple the latch member with the panel.

16. The module of claim 13, wherein the latch member comprises a plurality of mounting protrusions, wherein the panel comprises a plurality of apertures and a spring portion, wherein the protrusions are configured to snap into the apertures to couple the latch member with the panel, wherein the spring portion is configured to bias the protrusions against sides of the apertures such that the latch member is retained on the panel.

17. A system, comprising:

a rack enclosure;

a module configured to couple with the rack enclosure, comprising:

a panel comprising a groove;

an injector/ejector coupled to the panel, wherein the injector/ejector is configured to reside substantially in the groove when the injector/ejector is in a closed position; and a latch member coupled to the panel comprising a body and a handle portion, the latch member configured to latch the injector/ejector in a closed position, wherein the body of the latch member resides substantially in the groove;

wherein the module comprises a slot, wherein a portion of the injector/ejector is configured to move through the slot during use of the injector/ejector, wherein the rack enclosure, the module, and the injector/ejector form an enclosure to contain electromagnetic emissions produced by components of the module.

18. A module, comprising a panel comprising a groove;

an injector/ejector coupled to the panel, the injector/ejector being configured to reside substantially in the groove when the injector/ejector is in a closed position; and a latch member coupled to the panel comprising a body and a release portion, the latch member being configured to latch the injector/ejector in a closed position, wherein the body of the latch member resides substantially in the groove; and wherein the panel comprises a fold, wherein the fold defines the groove.

19. A module, comprising a panel comprising a groove;

an injector/ejector coupled to the panel, the injector/ejector being configured to reside substantially in the groove when the injector/ejector is in a closed position;

a latch member coupled to the panel comprising a body and a release portion, the latch member being configured to latch the injector/ejector in a closed position, wherein the body of the latch member resides substantially in the groove; and an enclosure coupled to the panel, wherein the enclosure and the panel each comprises a slot configured to allow a portion of the injector/ejector to move through the slot during use of the injector/ejector.

20. A module, comprising a panel comprising a groove;

an injector/ejector coupled to the panel, wherein the injector/ejector is configured to reside substantially in the groove when the injector/ejector is placed in a closed position; and a latch member coupled to the panel the latch member configured to latch the injector/ejector in a closed position, wherein the latch member is configured to snap into at least one aperture in the panel;

wherein the latch member comprises a plurality of mounting protrusions, wherein the panel comprises a plurality of apertures, and wherein the protrusions are configured to snap into the apertures to couple the latch member with the panel.

* * * * *